US007731448B2

(12) United States Patent
Fillie

(10) Patent No.: US 7,731,448 B2
(45) Date of Patent: Jun. 8, 2010

(54) PORTABLE RUMBLE STRIP

(76) Inventor: Anthony Fillie, 49 Delaware Ave., Waterbury, CT (US) 06708

( * ) Notice: Subject to any disclaimer, the term of this patent is extended or adjusted under 35 U.S.C. 154(b) by 0 days.

(21) Appl. No.: 12/099,370

(22) Filed: Apr. 8, 2008

(65) Prior Publication Data

US 2008/0260458 A1 Oct. 23, 2008

Related U.S. Application Data

(60) Provisional application No. 60/923,132, filed on Apr. 11, 2007.

(51) Int. Cl.
*E01F 9/047* (2006.01)

(52) U.S. Cl. ..... 404/15

(58) Field of Classification Search ..... 404/15, 404/16

See application file for complete search history.

(56) References Cited

U.S. PATENT DOCUMENTS 1,265,404 A * 5/1918 Tuteur ..... 404/15
1,357,860 A * 11/1920 Goodrum ..... 238/3
4,135,839 A * 1/1979 Engwall ..... 404/16
4,790,684 A * 12/1988 Adams ..... 404/16
5,242,242 A * 9/1993 Young ..... 404/12
5,769,563 A * 6/1998 Flynn ..... 404/15
5,775,834 A * 7/1998 Jackson ..... 404/15
6,259,374 B1 * 7/2001 Kisner et al. ..... 340/905
6,309,137 B1 * 10/2001 Hirsch ..... 404/15
7,168,886 B2 * 1/2007 Loader ..... 404/75
7,302,825 B2 * 12/2007 Knox ..... 73/11.04
7,591,605 B2 * 9/2009 Jonasz et al. ..... 404/15
7,625,152 B2 * 12/2009 Swamidass ..... 404/12
2003/0194271 A1 * 10/2003 Solon ..... 404/15
2008/0095575 A1 * 4/2008 Swamidass ..... 404/16

* cited by examiner

*Primary Examiner*—Gary S Hartmann
(74) *Attorney, Agent, or Firm*—Gregory S. Rosenblatt; Wiggin and Dana LLP

(57) ABSTRACT

A portable rumble strip that is adapted to conform to a roadway having a base portion, grips that adhere to the roadway, and a plurality of vibrators protruding away from the roadway. The vibrators are effective to cause a vibration in a tire when engaged by a moving vehicle and effectively alerting the driver of the vehicle.

11 Claims, 4 Drawing Sheets

PORTABLE RUMBLE STRIP

CROSS REFERENCE TO RELATED APPLICATION(S)

This patent application claims priority to U.S. Provisional Patent Application Ser. No. 60/923,132 titled "Portable Rumble Strip" that was filed on Apr. 11, 2007. The subject matter of that provisional patent application is incorporated by reference in its entirety herein.

U.S. GOVERNMENT RIGHTS

N.A.

BACKGROUND

Rumble strips are commonly found on highways across the country. They are an effective way to prevent accidents and keep drivers alert. Typically, rumble strips are installed in the asphalt of the roadway, becoming part of the road. The rumble strips are grooves in the road, commonly in the shoulder lane of the road, that cause a vibration as a vehicle travels over them. This type of rumble strip, known as a shoulder rumble strip is placed just beyond the travel way to warn drivers they are entering a part of the roadway not intended for routine traffic use. The tires of a vehicle passing over the rumble strips drop into the grooves, which causes tire noise and vehicle vibration.

Generally, there are four types of rumble strips used on roadways; milled, rolled, formed and raised.

Milled rumble strips are the most common type of rumble strips because they can be used on new or existing roads. Milled rumble strips are made by cutting or grinding into the pavement surface with a machine having a rotary cutting head, which creates a smooth, uniform, and consistent groove into the road shoulder. The tires of vehicles that travel over the milled rumble strips drop into the grooves creating tire vibration and noise.

Rolled rumble strips are rounded or V-shaped grooves that are pressed into hot asphalt pavements and shoulders when the surface is compacted. The strips are made by a roller with steel pipes welded to drums, which make the depressions as they pass over the hot pavement.

Formed rumble strips can have similar shapes as rolled rumble strips, but are made by pressing forms into concrete shoulders as they are being constructed.

Raised rumble strips are rounded or rectangular markers or strips that permanently adhere to new or existing pavements. Their height can range from 6 mm to 13 mm, and therefore the use of raised rumble strips is usually restricted to climates where snow removal is not required. Raised rumble strips are typically made from raised humps of asphalt, but can be made from a variety of materials.

These rumble strips generally serve to alert a driver who drifted into the shoulder. As the tires of a vehicle ride over the rumble strips a vibration alerts the driver that they have crossed out of the lane into shoulder.

Typically, permanent rumble strips have no color for visibility or reflectors and are subject to weather deterioration after years of wear. Additionally, they are costly to repair. Generally, all permanent rumble strips hold water and deteriorate from weather, particularly on concrete roads because of pockets that form in the pavement.

Rumble strips can also serve as a warning for road construction or a disabled vehicle ahead. Typically, due to the temporary nature of road work or an accident, permanent rumble strips would not be cost effective or practical. In a work zone, a portable rumble strip would likely be used for the duration of the project. Currently, temporary or portable rumble strip are in the form of raised strips that are applied to a roadway with a weighted roller. One side of the strips has an adhesive backing to adhere to the road, while the opposite side is raised to cause a vibration in a vehicle passing over the strips. Several strips are typically applied in a row to create a vibration when passed over. These portable rumble strips are time consuming to apply and therefore would not be practical for use in an emergency situation. Further, a weighted roller is needed to apply the strips which makes them unreasonable for use by a lay person.

Although rumble strips are becoming more common on roadways, the majority of roads do not have them. According to 2003 report issued by the United States Department of Transportation, Federal Highway Administration, fifty nine percent of vehicle fatalities are due to vehicles that run off the road. Rumble strips are an effective way to reduce this statistic.

In addition, according to the same report above, over 1,000 people are fatally injured in work zone vehicle accidents each year, and over 40,000 people are injured each year as a result of vehicle crashes in work zones in the United States. Rumble strips are not on every road, therefore their benefits are not as widely utilized as possible. The number of accidents can be reduced if rumble strips could be used by any traveler, and in every work zone.

BRIEF SUMMARY

The details of one or more embodiments of the present disclosure are set forth in the accompanying drawings and the description below. Other features, objects and advantages of the present disclosure will be apparent from the description and drawings, and from the claims.

In one embodiment, there is provided a portable rumble strip having a base with a first and an opposing second side, the first side is adapted to conform to a roadway, the opposing second side extends outward from the roadway; grips orientated on the first side of the base are effective to restrict movement of the base due to engagement with the moving vehicle; and vibrators extending a length of the base, have a first side flush with the first side of the base and an opposing second side protruding away from the base effective to cause a vibration when engaged by a moving vehicle.

In another embodiment of the disclosed subject matter, there is provided a portable rumble strip having a first and second side rail parallel to one another. Each side rail having a top surface, a bottom surface, an inner surface and an outer surface. The bottom surface of the side rails is adapted to conform to a roadway. A plurality of vibrators are perpendicular to the inner surface of the first and second side rail. A first side of the plurality of vibrators is flush with the bottom surfaces of the first and second side rails, and a second side of said plurality of vibrators extends above said top surface and are effective to cause a vibration when engaged by a moving vehicle.

DETAILED DESCRIPTION OF THE DRAWINGS

Figure 1:
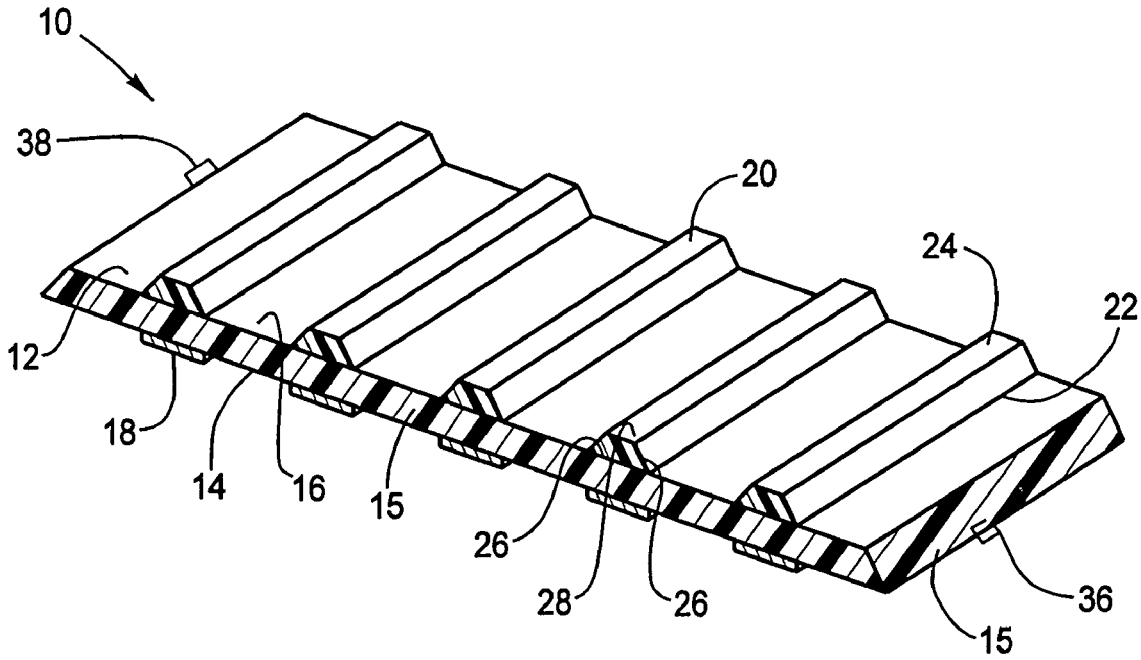
FIG. 1 shows a portable rumble strip in accordance with the present disclosure.
Figure 1A:
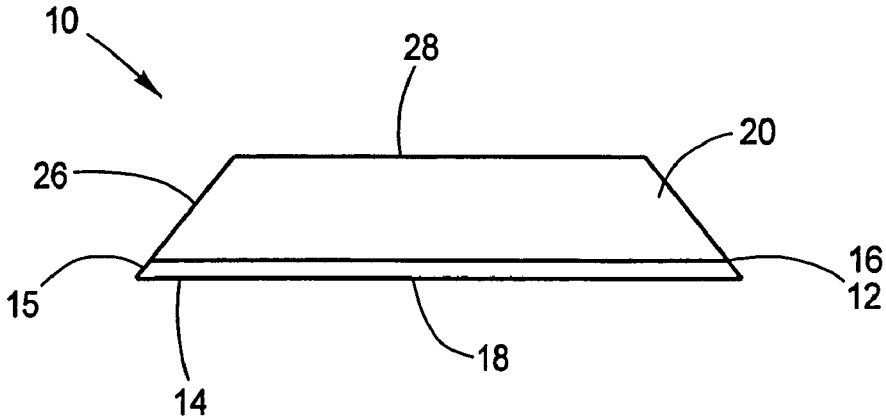
FIG. 1*a* shows a front view of a portable rumble strip in accordance with the present disclosure.

Referring now to the drawings in which like reference numerals indicate like parts, and in particular, to FIGS. 1 and 1*a*, one aspect of the present application is a portable rumble strip 10 having a base 12, grips 18, and vibrators 20. In one embodiment, as shown in FIG. 1, base 12 can have a rectangular shape. Base 12 has nominal dimensions of about 20 inches (20") wide by about 15 feet (15') long and a thickness of about one eighth (⅛"). Typically, base 12 is constructed from a plastic material or nylon that has flexibility to allow the base to be rolled for storage. Base 12 has a first side 14 which is adapted to conform with a roadway, and an opposing second side 16, which extends from the roadway. Typically, the edges 15 of base 12 are sloped or angled to allow a vehicle to smoothly ride onto and off portable rumble strip 10.

In one embodiment as shown in FIG. 1, on first side 14 of portable rumble strip 10 are located grips 18. Grips 18 create contact between base 12 and the road. Grips 18 can be in the form of a rubber traction element that covers a portion or the entire surface of base 12. Typically, grips 18 are made from a rubber material. The rubber used for grips 18 should be flexible, soft to medium possibly flexible if flexible to adhere to the pavement. Grips 18 are effective to restrict portable rumble strip 10 from moving when a vehicle comes in contact with it. The thickness of grips 18 can vary. Grips 18 will adhere to any road surface keeping portable rumble strip 10 in place when driven on.

On opposing second side 16 of base 12 is disposed a plurality of vibrators 20. Vibrators 20 have a first side 22 and an opposing second side 24. First side 22 of vibrators 20 can be mounted on base 12 as shown in FIG. 1, or can be flush with first side 14 of base 12 adapted to conform to the road. Opposing second side 24 of vibrators 20 extends away from the road. Vibrators 20 can be made from a plastic material with enough strength to withstand a vehicle traveling over the vibrators without deforming the vibrators and without damaging the tires of the vehicle. As a vehicle travels over vibrators 20, the vibrators but be able to withstand the weight of the vehicle, and also not destroy the vehicles tires that travel over the vibrators. Vibrators 20 are nominally approximately three inches (3") wide, and between fifteen (15") to twenty inches (20") long. The height of vibrators 20 is in the range of about two inches to about three inches (2"-3"). Each vibrator 20 is spaced between about three inches (3") and five inches (5") apart from one another, a space effective to cause a continuous vibration in the vehicles tires when they travel of the vibrators. For example, when a vehicle's tires come into contact with vibrators 20, a vibration and noise will be caused in the tire and the driver of the vehicle will be able to feel the vibration and hear the noise inside the vehicle thereby alerting the driver.

In one embodiment, as shown in FIGS. 1 and 1*a*, vibrators 20 are in the shape of trapezoids, having a plurality of sloped sides 26 and a flat top portion 28. Sloped sides 26 of vibrators 20 enable a vehicle to ride onto and off of the vibrators without damaging the vehicle. The shape of vibrators 20, however, can be any shape such as pyramids, hemispheres or any other shape effective to create a vibration to a tire when the tire rolls over the vibrator without damaging the tire or the vibrator.

All or a portion of vibrators 20 can be a bright color such as yellow or orange and/or reflective to increase visibility of the vibrators to a driver. The color and/or the reflectivity may be a coating, such as paint. Alternatively, all or a portion of vibrators 20 can be constructed of a colored plastic or covered with a reflective tape. The bright color of vibrators 20 increases the visibility of the vibrators to the driver, thereby increasing the effectiveness. In another embodiment, the entire portable rumble strip 10 can be made of a bright fluorescent color, making the portable rumble strip reflective in the dark when light is shined on it.

Figure 2:
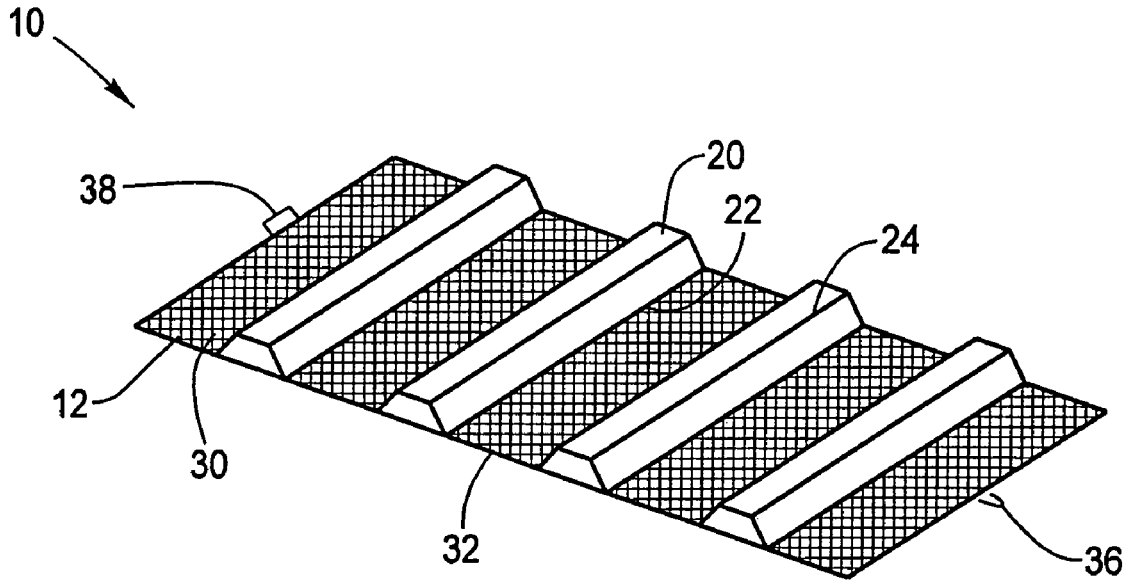
FIG. 2 shows a second embodiment of a portable rumble strip in accordance with the present disclosure.

Referring now to FIG. 2, another embodiment of the present application is shown. In this embodiment, portable rumble strip 10 has a base 12 that is formed of a netting material 30. Netting material 30 can be made with a flexible plastic material, such as injection molding. The use of netting material 30 as base 12 of portable rumble strip 10 decreases the weight of the portable rumble strip, making transport easier. The use of the netting material 30 provides for a strong portable rumble strip that is still flexible and can be rolled up for storage. In one embodiment, netting material 30 has a thickness of approximately one eighth of an inch (⅛"). The thickness of netting material 30 can be varied. A first side 32 of netting material 30 is adapted to conform with a road, while an opposing second side 34 of the netting material extends away from the road. One first side 32 of netting material 30 can be disposed a plurality of grips 18 as discussed above. However, it is contemplated that if netting material 30 is made from a material, such as rubber, it will be effective to create friction between portable rumble strip 10 and the road, and grips 18 may not be necessary because, the entire portable rumble strip grips the road.

On opposing second side 34 of netting material 30 are affixed a plurality of vibrators 20. Vibrators 20 are generally spaced uniformly across netting material 30. The plurality of vibrators 20 are spaced approximately three inches (3") to five inches (5") apart. A first side 22 of vibrators 20 is flush with netting material 30 while an opposing second side 24 of the vibrators extends away from the road to form a bump. Vibrators 20 are substantially similar to those discussed above.

FIGS. 1 and 2, portable rumble strip 10 can designed to be rolled up into a tubular form for storage or carting. Vibrators 20 are spaced apart so that when portable rumble strip 10 is rolled up, the vibrators interlock to make the portable rumble strip as compact as possible. Portable rumble strip 10 can have a fastening means, such as a hook 36 and eye 38, to secure the portable rumble strip in the tubular form for storage. Hook 36 and eye 38 can be made of plastic. Hook 36 and eye 38 can also be used to lock several portable rumble strips 10 together. Any other means can be used to secure portable rumble strip 10 in the tubular position, such as a strap, buckle or other locking mechanism.

Figure 3:
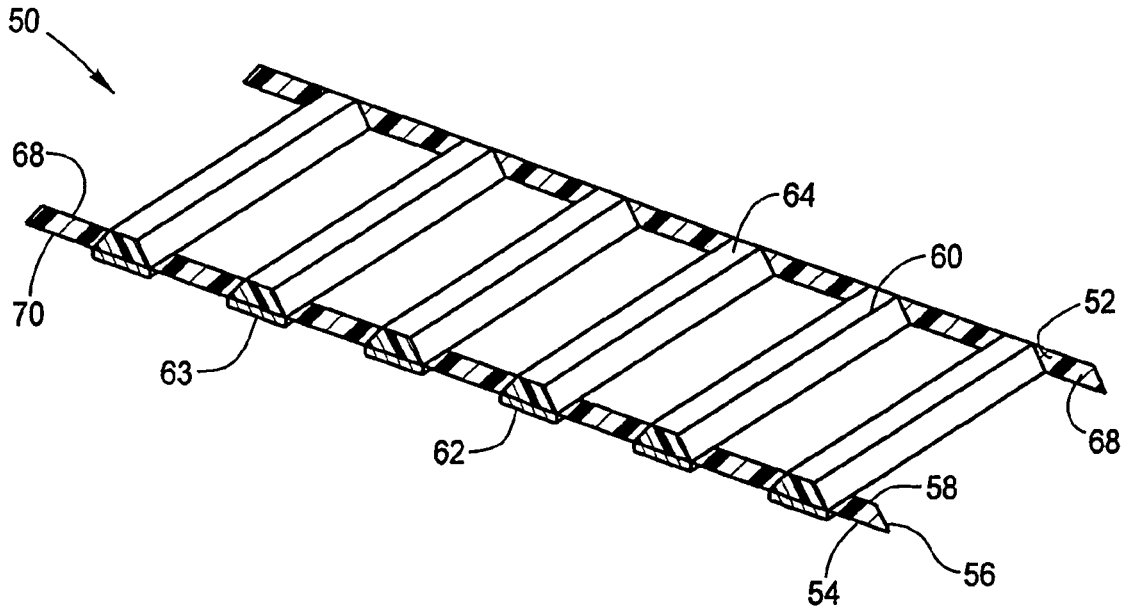
FIG. 3 shows yet another embodiment of a portable rumble strip in accordance with the present disclosure.

Yet another embodiment of portable rumble strip 50 is shown in FIG. 3. In FIG. 3, portable rumble strip 50 is constructed a first side rail 52 and a second side rail 54, which are substantially parallel to one another. First side rail 52 and second side rail 54 have a height in the range of about one inch (1") to about five inches (5"). First side rail 52 and second side rail 54 are spaced nominally approximately twenty inches (20") apart from one another. First side rail 52 and second side rail 54 can be made from a flexible plastic such as nylon or any other flexible plastic known in the art. First side rail 52 and second side rail 54 each have a top surface 58 that extends away from the roadway, a bottom surface 56 adapted to conform with a roadway, an inner surface 68 and an outer surface 70. A plurality of vibrators 60 run perpendicular to side rails 52 and 54. Vibrators 60 typically are affixed to inner surface 68 of first side rail 52 and second side rail 54. Vibrators 60 are nominally approximately twenty inches (20") in length and three inches (3") wide. The height of vibrators 60 is in the range of about two inches (2") to about four inches (4") and are made from a flexible plastic material. A first side 62 of vibrators 60 is flush with bottom surface 56 of first side rail 52 and second side rail 54 adapted to conform to a roadway. The opposing second side 64 of vibrators 60 extends beyond top surface 58 of first side rail 52 and second side rail 54 by approximately three inches (3"), enough to create an uneven surface so that when a vehicle travels over portable rumble strip 50 the vibrators cause a vibration in the vehicles tires.

As shown in FIG. 3, grips 63 can be located on first side 62 of vibrators 60. The first side 62 of the vibrators 60, which is adapted to conform to the road, can have grips 63 affixed thereto. The grips 63 can be a rubber material covering the entire surface of vibrator 20 that will contact the road. The rubber material of grips 63 has a thickness of approximately one quarter of one inch (¼"). Grips 63 provide traction, to restrict the movement of portable rumble strip 10.

Portable rumble strip 50 as shown in FIGS. 1-3 can be made entirely of injection molding, or another flexible strong plastic material. The manufacturing process of portable rumble strip can be thus condensed to a one step process, where the vibrators, grips, hook and eye would all be molded out of a single material. This would further create a more economical product.

Figure 4:
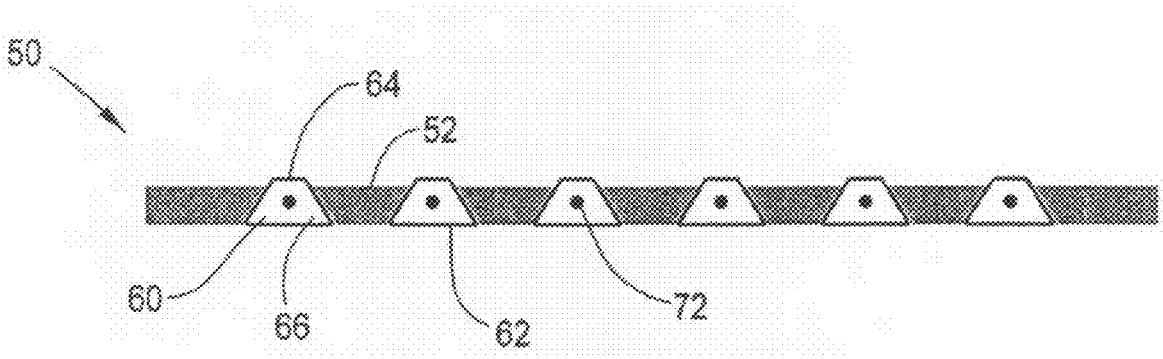
FIG. 4 shows a side view of a portable rumble strip in accordance with the present disclosure.

FIG. 4 shows yet another embodiment of the present disclosure. A side view of a portable rumble strip 50 is shown. In this view, vibrators 60 are shaped as trapezoids 66. This view shows how the opposing second side 64 of vibrators 60 extend above first side rail 52 and second side rail 54, extending away from the roadway, while the first side 62 of the vibrators is flush with bottom surface 56 of the side rails. Vibrators 60 can be affixed to first side rail 52 and second side rail 54 by using nylon pins 72 that extend through the center of the vibrators and attach to the side rails, as shown in FIG. 4. Vibrators 60 can be affixed to first side rail 52 and second side rail 54 using any other adhering means such as a screw and nut.

Portable rumble strip 10 has the advantage of being portable and still effective. Portable rumbles strips 10 can be used by any traveler. If a vehicle is in the shoulder of the road, portable rumble strip 10 can be placed before the vehicle in the shoulder to warn other traffic that there is a hazard ahead. Additionally, police and other emergency vehicles can carry portable rumble strip 10 in their vehicles to use when they are assisting a disabled vehicle. The rumble strip serve as a safety precaution. These portable rumble strips can also be used in work zones. Although there are signs warning driver of work zones and men working on the roadways, it would be more effective to place portable rumble strip 10 on the roadway before the work zone to alert drivers to slow down. When the portable rumble strips are driven on before seeing any signs, cones or barrels, the driver will become much more aware and cautious.

An alternative embodiment of this portable rumble strip 10 is to construct the apparatus using injection molding or the like, to minimize cost. The portable rumble strip can be used in any climate, even on top of snow or ice. The portable rumble strips can be removed and placed back down and are highly visible to drivers during the night or day. The portable rumble strips can be used in conjunction with cones or barrels on construction sites and can also be transported by state troopers or other officials in the trunk of a car due because they can be rolled up. The portable rumble strip can be used anywhere and can be made any length.

One or more embodiments of the present invention have been described. Nevertheless, it will be understood that various modifications may be made without departing from the spirit and scope of the invention. Accordingly, other embodiments are within the scope of the following claims.

I claim:

1. A portable rumble strip comprising:

a base having a first and an opposing second side, said first side adapted to conform to a roadway, said opposing second side extending outward from said roadway;

grips orientated on said first side of said base effective to adhere said base to said roadway by friction; and vibrators extending a length of said base, having a first side flush with said first side of said base and an opposing second side protruding away from said base effective to cause a vibration when engaged by a moving vehicle, said vibrators second sides being spaced apart so that when said portable rumble strip is rolled up, said vibrators interlock for storing and carting without damaging said portable rumble strip.

2. The portable rumble strip of claim 1, wherein said portable rumble strip is fabricated of a flexible material.

3. The portable rumble strip of claim 1, wherein said base has a substantially rectangular shape.

4. The portable rumble strip of claim 1, wherein said base is netting material.

5. The portable rumble strip of claim 1, wherein said base has a plurality of sloped edges.

6. The portable rumble strip of claim 1, wherein said plurality of vibrators are raised surfaces having a trapezoidal shape.

7. The portable rumble strip of claim 6, wherein said plurality of vibrators have a reflective coating.

8. The portable rumble strip of claim 1 including a hook at one end of said portable rumble strip and an eye at an opposing end of said portable rumble strip effective to both secure said portable rumble strip in a tubular form for storage and to lock said portable rumble strip to another portable rumble strip.

9. The portable rumble strip of claim 1, wherein said portable rumble strip is fabricated by injection molding.

10. The portable rumble strip of claim 1 wherein said grips are a plurality of discrete traction elements.

11. The portable rumble strip of claim 10 wherein said grips are formed of a soft rubber.

* * * * *